United States Patent [19]

Suey

[11] Patent Number: 4,793,900

[45] Date of Patent: Dec. 27, 1988

[54] UNIVERSAL COKE OVEN DOOR LINER

[76] Inventor: Paul V. Suey, 1043 Black Forest Dr., Pittsburgh, Pa. 15235

[21] Appl. No.: 134,352

[22] Filed: Dec. 17, 1987

Related U.S. Application Data

[63] Continuation-in-part of Ser. No. 932,884, Nov. 20, 1986, Pat. No. 4,744,867.

[51] Int. Cl.[4] ..... C10B 25/16
[52] U.S. Cl. ..... 202/248; 202/269
[58] Field of Search ..... 202/242, 248, 269

[56] References Cited

U.S. PATENT DOCUMENTS

| | | | |
|---|---|---|---|
| 2,993,845 | 7/1961 | Coe | 202/248 |
| 4,118,284 | 10/1978 | Bowman et al. | 202/248 |
| 4,197,163 | 4/1980 | Aikman | 202/248 |
| 4,216,061 | 8/1980 | Blase | 202/248 |
| 4,217,177 | 8/1980 | Gerding et al. | 202/248 |
| 4,381,972 | 5/1983 | Stog | 202/248 |
| 4,414,072 | 11/1983 | Breidenbach | 202/248 |

FOREIGN PATENT DOCUMENTS

| | | | |
|---|---|---|---|
| 154232 | 9/1985 | European Pat. Off. | 202/248 |
| 3528512 | 5/1986 | Fed. Rep. of Germany | 202/248 |

*Primary Examiner*—David L. Lacey
*Assistant Examiner*—Joye L. Woodard
*Attorney, Agent, or Firm*—Parmelee, Miller, Welsh & Kratz

[57] ABSTRACT

A universal coke oven door for use on varying width oven chambers in a coke oven battery is formed with hot side refractory sections and cold side refractory sections spaced therefrom. Ceramic wiper strips are provided which extend outwardly from the sides of the hot side refractory sections towards the oven doorjambs to prevent passage of coal or coke between the hot side refractory layer and the doorjambs. Sole plates may be provided on the bottommost refractory sections of the hot side or cold side refractory layers, while an extension is provided on the topmost refractory section of the hot side refractory layer which extends towards the cold side refractory layer and prevents coal or coke from entering the spacing between the two refractory layers.

11 Claims, 2 Drawing Sheets

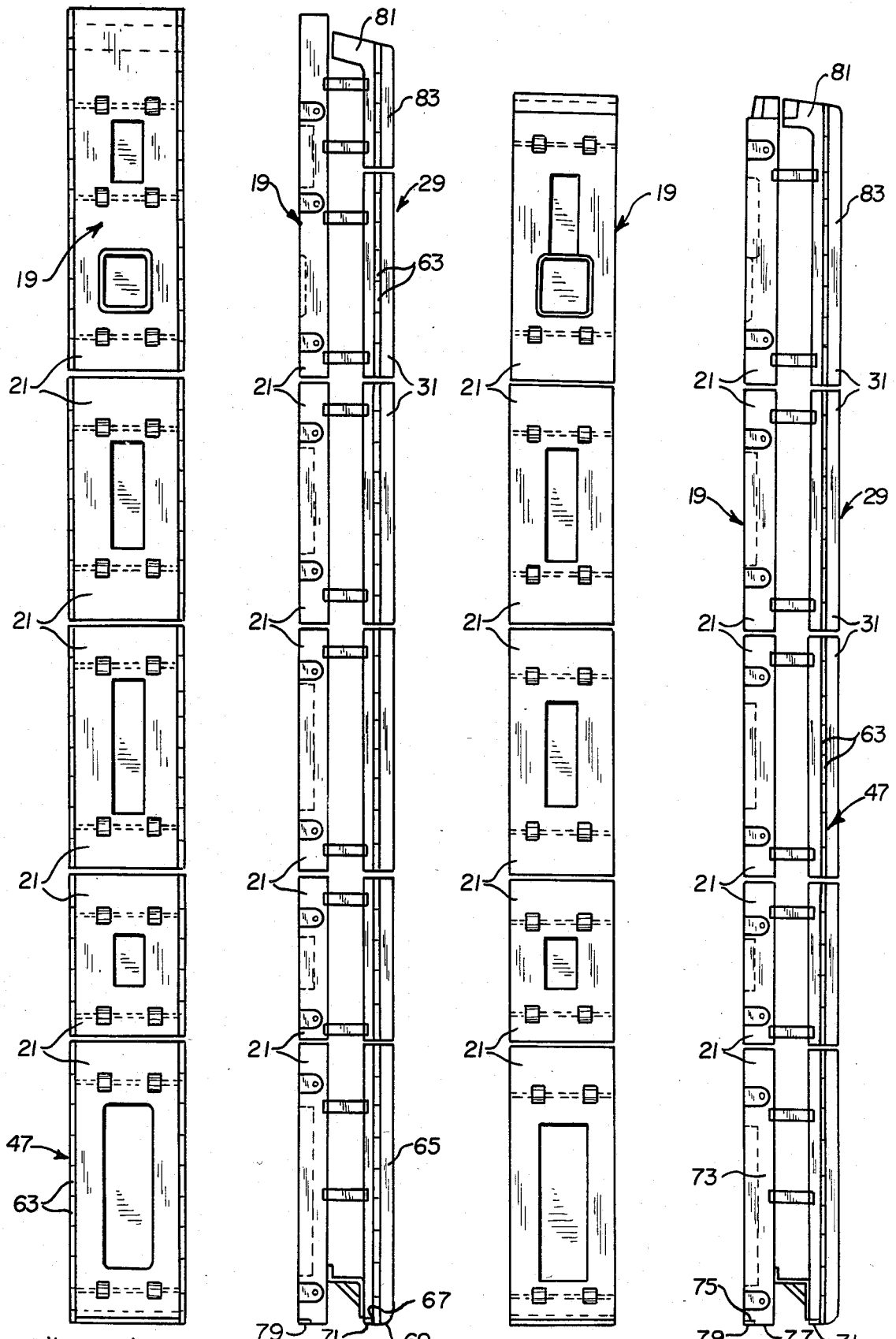
81
83
19
29
63
21
31
47
65
67
79
71
73
75

UNIVERSAL COKE OVEN DOOR LINER

REFERENCE TO RELATED APPLICATION

This application is a continuation-in-part of my co-pending application Ser. No. 932,884, filed Nov. 20, 1986, entitled "Door Liner and Door Assembly for a Coke Oven", now U.S. Pat. No. 4,744,867.

BACKGROUND OF THE INVENTION

The present invention relates to an improvement on the door liner and door assembly for a coke oven as described in my co-pending application, Ser. No. 932,884, the contents of which application are incorporated by reference herein.

As described in my said co-pending application, earlier attempts to provide a door plug that was spaced apart from the metal door in a coke oven door assembly resulted in problems of condensation of coking gases on the inside surface of the metal door and doorjambs, which condensed gases formed hard dense deposits that interfered with the seal between the metal door and the jambs, and which tended to plug the gas channel areas.

These problems were solved by use of the door liner and door assembly described and claimed in my said co-pending application, wherein first and second spaced refractory layers were provided, one on the cold side, or door side, of the assembly and the other on the hot side, or coke side, of the assembly. These layers were each constructed from a plurality of abutting, vertically aligned sections with the cold side refractory layer having a recess in the surface of the sections facing the door, in which an insulating material was disposed. With this assembly, gases entered on elongated chamber formed between the first and second refractory layers so as to rise to the top portion of the coke oven chamber without condensation occurring between the spaced refractory layers.

While the above-described door liner and door assembly was a distinct advance over prior art designs, under certain conditions various problems were encountered. One problem was associated with occasional overfilling the coke side top. Overfilled coal can be snow-plowed ahead of the leveler bar of the coke oven charging machine, with a resultant forcing of some coal over the coke side hot face refractory layer and such coal can find its way into the elongated chamber between the hot side refractory and cold side refractory layers. When such displaced coal becomes heated, gases are produced which are forced into the original gas channel area and condensed.

A further problem that was encountered under certain conditions was in connection with the bottommost refractory layer. Some of the coal which can enter through the top of the door, between the hot face and cold face refractory layers, can coke and cling to the oven hearth. When the door is pulled, for discharging of the oven, such coke clinging to the oven hearth can cause the bottommost hot face refractory section to hang up and possibly eventually crack that section.

A more consistent difficulty with the proposed door liner and assembly, however, was not the result of the construction thereof but rather the non-uniformity of the coke oven walls even in a single series of ovens. It has been found, in practice, that coke oven walls are very irregular and there is some difference in width of an oven from one oven to the next even within the same coke oven battery. With such a variation in oven widths, an ideally designed gap between one oven wall and the sides of the hot face refractories of my door might be, in some ovens either too wide or non-existent. A too wide of a gap permits coal to intrude through the gap to the gas exhaustion area provided between the two spaced refractory layers, which could cause the door to fail. On the other hand, if a sufficiently sized gap is not present, the door may be caused to stick during removal and this can cause refractory failing by cracking. Needless to say, the customer abhors the possibility of having to purchase a specific sized door for each oven in a battery, having various oven widths, with selective fitting of a particular door to a particular oven.

It is an object of the present invention to provide a coke oven door and liner that has spaced refractory layers which are suitable for use in coke ovens of non-uniform width, with a door adaptable for use in all coke oven chambers of a coke oven battery without modification due to varying widths of specific chambers in the battery.

SUMMARY OF THE INVENTION

A coke oven door, for sealing a coke oven chamber having a doorjamb at the end of the vertical side walls of the chamber, has a metallic door panel attached to a door frame, a cold side refractory layer, formed from refractory sections having cavities therein containing an insulating material secured to the door panel, and a hot side refractory layer spaced from the cold side refractory layer and secured thereto, formed from refractory sections, the hot side refractory layer having side walls slightly spaced from and confronting the door jambs. A groove is provided in the side walls of the hot side refractory and a ceramic wiper strip secured in the groove and extending outwardly therefrom towards the doorjambs and adapted to substantially close the spacing between the side walls of the hot side refractory layer and the doorjambs so as to permit the passage of gases therebetween but block the passage of solid coal or coke.

The hot side refractory layer bottommost section preferably has a recess therein in the bottom edge thereof facing the cold side refractory layer, with a metallic sole plate secured in the recess, while the cold side refractory layer bottommost section may also have a recess therein at the bottom edge facing the door panel, with a second metallic sole plate also provided in the recess in the cold side refractory layer and extending thereacross.

A further embodiment of the invention provides an extension formed with the topmost section of the hot side refractory layer which extends towards the cold side refractory layer and prevents coal or coke from entering the spacing between the two refractory layers from the top thereof.

DESCRIPTION OF THE DRAWINGS

In the drawings:

FIG. 4 is an elevational view of the metallic door panel facing surface of a coke side, cold side refractory layer;

FIG. 5 is a side view of the cold side refractory layer and hot side refractory layer used on the coke side of an oven;

FIG. 6 is an elevational view of the metal door panel facing surface of a pusher side, cold side refractory layer; and FIG. 7 is a side view of a cold side refractory layer and hot side refractory layer used on the pusher side of an oven.

DETAILED DESCRIPTION

Figure 1:
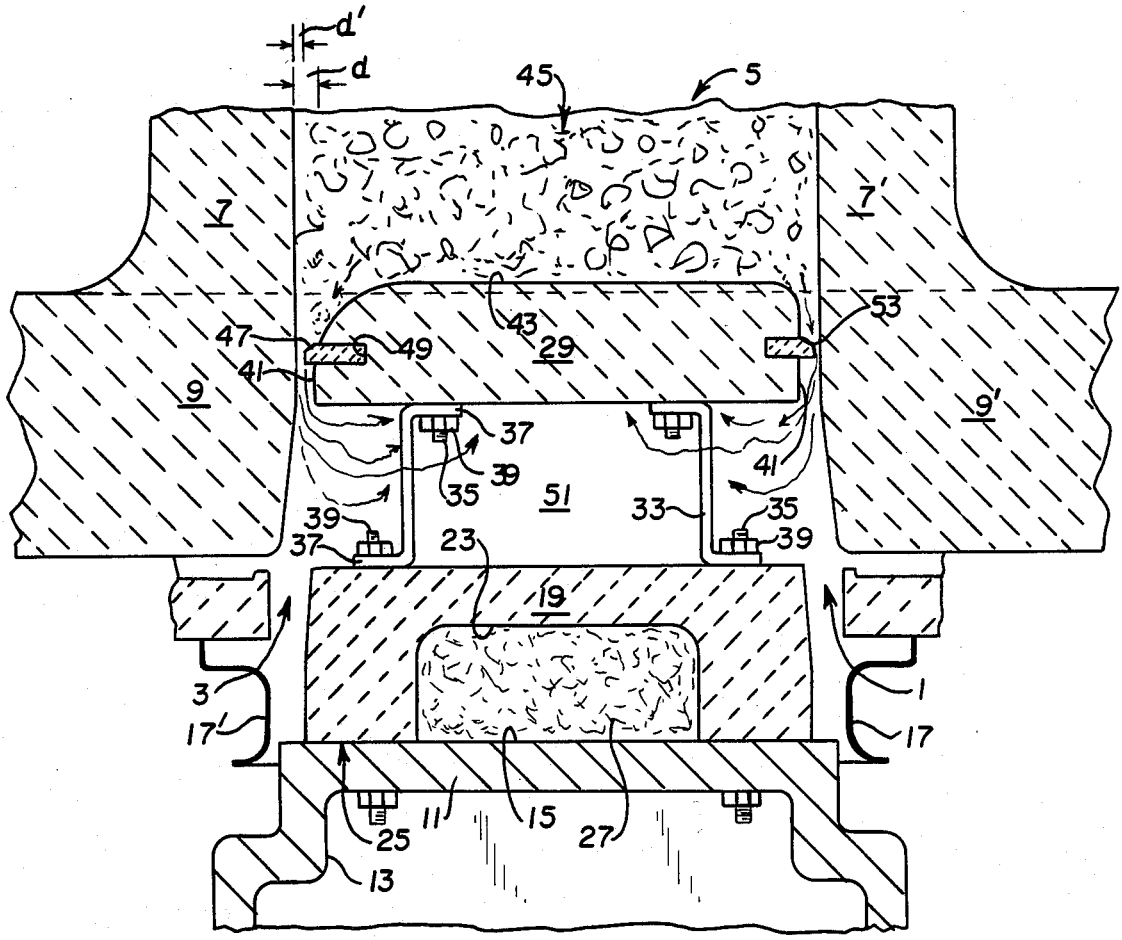
FIG. 1 is a cross-sectional view of the coke oven door of the present invention in place sealing the opening to a coke oven chamber.

Referring now to the drawings, a coke oven door 1 of the present invention is illustrated. As shown in FIG. 1, the coke oven door 1 seals an opening 3 to a coke oven chamber 5 of a coke oven, the chamber 5 having vertical side walls 7, 7' and doorjambs 9, 9' at the ends of each of the side walls. The coke oven door 1 has a metallic door panel 11 generally formed as part of a door frame 13, the metallic door panel 11 having an inner surface 15 which faces the coke oven chamber 5 when the door is positioned to close the chamber. Sealing rings 17, 17' are provided thereon to contact the doorjambs 9, 9' in sealing engagement, all of these components being part of a conventional coke oven door system.

A cold side refractory layer 19 is secured to the inner surface 15 of the metallic door panel 11. The cold side refractory layer 19 is formed from adjacent refractory sections 21, each of which sections 21 (FIGS. 4 to 7) have a cavity 23 therein in the surface 25 thereof which contacts the metallic door panel 11. An insulating material 27 fills each cavity 23. A hot side refractory layer 29 is attached to the cold side refractory layer 19, in spaced relationship thereto, the hot side refractory layer also being formed from adjacent refractory sections 31. The cold side refractory layer 19 and hot side refractory layer 29 are secured in spaced relationship such as by Z-shaped bars 33 secured to each of the refractory layers by bolts 35 imbedded in the refractory layers, which pass through bores 37 in the Z-shaped bars 33 and are secured thereto by nuts 39. As is shown in FIG. 1, the hot side refractory layer 29 has side walls 41 which are slightly spaced from and confronting the doorjambs 9, 9' when the coke oven door is in place to seal the coke oven chamber 5, with the inner face 43 of the hot side refractory layer adapted to contact coal 45 which is coked in the oven chamber 5.

The side walls 41 of the hot side refractory layer 29 are slightly spaced from the doorjambs 9, 9' a distance d of about 0.75 inch so as to compensate for variations in the width of a plurality of coke oven chambers 5 in a coke oven, such a gap being sufficient to enable fitting of the hot side refractory layer 29 into the narrowest oven of the coke oven battery and thus into all chambers in that oven battery.

Since such a distance d could be such that coal or coke could pass between the side walls 41 of the hot side refractory layer 29 and the doorjambs 9, 9', a wiper strip 47 is provided. A groove 49 is formed in the side walls 41 of the hot side refractory layer 29 refractory sections 21, which groove extends vertically therein. The wiper strip 47 is secured in the groove 49 and extends outwardly therefrom and is adapted to substantially close the spacing between the side walls 41 of the hot side refractory layer 29 and the doorjambs 9, 9'. Complete sealing of the distance d is not desired since gas flow is to be encouraged from the coke oven chamber to the space 51, as indicated by the arrows in FIG. 1, but the wiper strip 47 should substantially close the spacing therebetween, to a lesser distance d', preferably of about 0.25 inch. The terminus 53 of the wiper strip 47 is thus slightly spaced from the doorjamb 9, 9' a distance d' sufficient to effect flow of gases therebetween but prevent passage of coal or coke.

Figure 2:
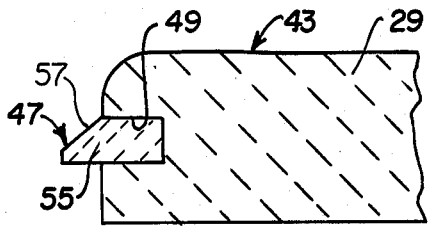
FIG. 2 is a horizontal cross-sectional view showing a wiper strip in a groove in the hot side refractory layer of the coke oven door of the present invention.
Figure 3:
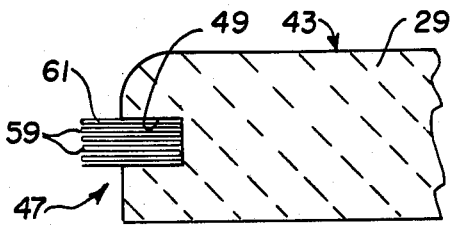
FIG. 3 is a horizontal cross-sectional view similar to that of FIG. 2 showing an alternative wiper strip.

The wiper strip 47 may comprise a molded member 55 of a ceramic material, as illustrated in FIG. 2, preferably having a vertically extending bevelled edge 57, secured in the groove 49. Such a wiper strip may be formed from a fibrous ceramic material, such as a freeze dried ceramic fiber form. Alternatively, the wiper strip 47, as illustrated in FIG. 3 can comprise a plurality of folds 59 of a ceramic fiber, sheet material 61 which is folded over upon itself and secured in the groove 49. The wiper strip 47, as illustrated in FIGS. 4 to 7 is preferably in the form of a plurality of segments 63. The wiper strip 47 is formed from a frangible ceramic material, such that the terminus 53, if it contacts the doorjambs due to a narrow width for a particular oven, will abrade and provide the necessary gap d'. The segments 63 may be formed from separate pieces of ceramic material that are secured into the groove 49, or a single wiper strip may be secured in the groove 49 and cuts made into the exposed section of the wiper strip to form the segments 63. The segments 63, which are preferably about 3 inches in length, allow for the replacement of only a portion of the wiper strip where damage may occur to the same, without the need to remove and replace a complete wiper strip 47 in a refractory section 31.

In a further embodiment of the present invention, the bottommost section 65 of the hot side refractory layer 29 has a recess 67 at the bottom edge 69 thereof which faces the cold side refractory layer 19, and a metallic sole plate 71, in the form of a metal plate, is secured in the recess 67 and extends across the hot side refractory layer bottommost section 65. The bottommost section 73 of the cold side refractory layer 19 also may preferably have a recess 75 at the bottom edge 77 thereof which faces the metallic door panel 11, and a metallic sole plate 79 is secured in the recess 75 and extends across the cold side refractory layer bottommost section 73. As an example, a 1½ inch thick carbon steel strip can be used as a sole plate, or a ⅜ inch by 2 inch wide—310 stainless steel strip can be used as a sole plate.

A yet further embodiment of the present invention (FIGS. 5 and 7) provides for means to prevent coal from entering the space 51 between the cold side refractory layer 19 and the hot side refractory layer 29 from above, by providing an extension 81 on the topmost section 83 of the hot side refractory layer 29 which extends towards the cold side refractory layer 19. In my co-pending application, Ser. No. 932,884, the use of an extension on the topmost vertical section of the door on the pusher side of the coke oven was disclosed. The present extension may however be used on either the pusher side of the oven, the coke side of the oven, or both, so as to prevent the entry of coal or coke, from above, into the spacing between the hot side refractory layer and the cold side refractory layer.

The present invention provides a universal door that can be fitted to varying widths of oven chambers in a coke oven battery. The wiper strips provide for narrowing the gap between a hot side refractory layer and the doorjambs so as to prevent egress of coal or coke into the spacing between the hot side refractory layer and a cold side refractory layer, while permitting passage of gases into said spacing, with the gases rising upwardly through the spacing. Sole plates are also provided to protect the bottommost section of the hot side and/or cold side refractory layers, while an extension is provided on the topmost section of the hot side refractory layer to prevent entry of coal or coke into the spacing from above.

What is claimed is:

1. A coke oven door adapted to substantially seal a coking chamber of a coke oven battery, the coking chamber having a doorjamb at the end of each of the walls forming the same, wherein said coke oven door has:

a metallic door panel having an inner surface;

a cold side refractory layer, secured to the inner surface of said metallic door panel, formed from a plurality of abutting, vertically aligned refractory sections, each of said refractory sections having a surface that contacts the door panel with a cavity therein, said cavity containing an insulating material;

a hot side refractory layer, formed from a plurality of abutting, vertically aligned refractory sections, spaced from and secured to said cold side refractory layer, each of said hot side refractory sections having side walls spaced from and confronting the doorjambs of a coking chamber;

a vertically extending groove in the side walls of each of said hot side refractory sections; and a frangible ceramic wiper strip secured in said grooves and extending outwardly therefrom and having an exposed portion, the exposed portion of said wiper strip adapted to substantially close the spacing between said side walls and the doorjambs of a coking chamber.

2. A coke oven door as defined in claim 1 wherein said ceramic wiper strip comprises a plurality of vertically adjacent strip secured in said vertical grooves of each of said refractory sections of said hot side refractory layer.

3. A coke oven door as defined in claim 1 wherein said ceramic wiper strip comprises a molded ceramic shape having a vertically extending bevelled edge.

4. A coke oven door as defined in claim 1 wherein said ceramic wiper strip comprises a plurality of folds of ceramic sheet material.

5. A coke oven door as defined in claim 1 wherein said hot side refractory layer has a bottommost section having a bottom edge, the bottommost section having a recess in said bottom edge extending thereacross and facing said cold side refractory layer and a first metallic sole plate secured in said recess.

6. A coke oven door as defined in claim 5 wherein said cold side refractory layer has a bottommost section having a bottom edge and a recess in said bottom edge of said cold side refractory layer extending thereacross and facing said door panel, and a second metallic sole plate secured in said recess of said cold side refractory layer.

7. A coke oven door as defined in claim 1 wherein said cold side refractory layer has a bottommost section having a bottom edge and a recess in the bottom edge extending thereacross and facing said door panel, and a metallic sole plate secured in said recess.

8. A coke oven door as defined in claim 1 wherein said hot side refractory layer has a topmost section, the topmost section having an extension formed therewith extending towards said cold side refractory layer to narrow the spacing therebetween sufficient to prevent coal being displaced into said spacing.

9. A coke oven door adapted to substantially seal a coking chamber of a coke oven battery, the coking chamber having a doorjamb at the end of each of the walls forming the same, wherein said coke oven door has:

a metallic door panel having an inner surface;

a cold side refractory layer secured to the inner surface of said metallic door panel, formed from a plurality of abutting, vertically aligned refractory sections, each of said refractory sections having a surface that contacts the door panel with a cavity therein, said cavity surface containing an insulating material;

a hot side refractory layer, formed from a plurality of abutting, vertically aligned refractory sections, spaced from and secured to said cold side refractory layer, each of said hot side refractory sections having side walls spaced from and confronting the doorjambs of a coking chamber;

a vertically extending groove in the side walls of each of said hot side refractory sections; and a frangible ceramic wiper strip secured in said grooves and extending outwardly therefrom and having an exposed portion, the exposed portion of said wiper strip adapted to substantially close the spacing between said side walls and the doorjambs of a coking chamber, said ceramic wiper strip comprising a plurality of vertically adjacent segments.

10. A coke oven door as defined in claim 9 wherein said hot side refractory layer has a bottommost section having a bottom edge, the bottommost section having a recess in said bottom edge thereof extending thereacross and facing said cold side refractory layer and a first metallic sole plate secured in said recess; and said cold side refractory layer has a bottommost section with a bottom edge having a recess in said cold side refractory layer bottom edge extending thereacross and facing said door panel, and a second metallic sole plate secured in said recess of said cold side refractory layer.

11. A coke oven door as defined in claim 10 wherein said hot side refractory layer has a topmost section, the topmost section having an extension formed therewith extending towards said cold side refractory layer to narrow the spacing therebetween sufficient to prevent coal being displaced into said spacing.

* * * * *